US005139085A

United States Patent [19]

Duvallet

[11] Patent Number: 5,139,085

[45] Date of Patent: Aug. 18, 1992

[54] FLUID SAMPLING BOTTLE USABLE IN DEEP BORE HOLES

[75] Inventor: Bernard Duvallet, Trappes, France

[73] Assignee: Commissariat A L'Energie Atomique, Paris, France

[21] Appl. No.: 691,344

[22] Filed: Apr. 25, 1991

[30] Foreign Application Priority Data

May 10, 1990 [FR] France ..... 90 05813

[51] Int. Cl.[5] ..... E21B 49/08

[52] U.S. Cl. ..... 166/165; 166/169; 166/321; 166/325

[58] Field of Search ..... 166/163, 264, 169, 164; 175/50, 59; 73/38, 863.84, 864.34, 864.62

[56] References Cited

U.S. PATENT DOCUMENTS 2,364,464 12/1944 Moore .
3,459,263 8/1969 Drivet .
3,530,933 9/1970 Whitten .
3,986,553 10/1976 Klyen .
4,583,595 4/1986 Czernichow et al. ..... 166/264
4,597,439 7/1986 Meek ..... 166/163
4,860,581 8/1989 Zimmerman et al. ..... 175/50 X
4,903,765 2/1990 Zunkel .
4,940,088 7/1990 Goldschild ..... 166/264 X

*Primary Examiner*—Ramon S. Britts
*Assistant Examiner*—Frank S. Tsay
*Attorney, Agent, or Firm*—Pearne, Gordon, McCoy & Granger

[57] ABSTRACT

A sample bottle makes it possible to sample mixtures of water and gases in deep bore or drill holes. The filling of the volume (4) of the bottle is obtained by placing a volume (4) under a vacuum beforehand. Once in place, the pipe (10) is opened by withdrawing the piston (20) and opening the valve (6). Once the pressures balance, the valve (6) closes again and the piston (20) is reintroduced into the sleeve (8). Pressure compensation is provided by a sliding valve member (46). Emptying takes place by means of the tap (24), which is also initially used to place the volume (4) under a vacuum. The sample bottle is applicable to geothermy, nuclear power stations, oceanography and geochemistry.

9 Claims, 3 Drawing Sheets

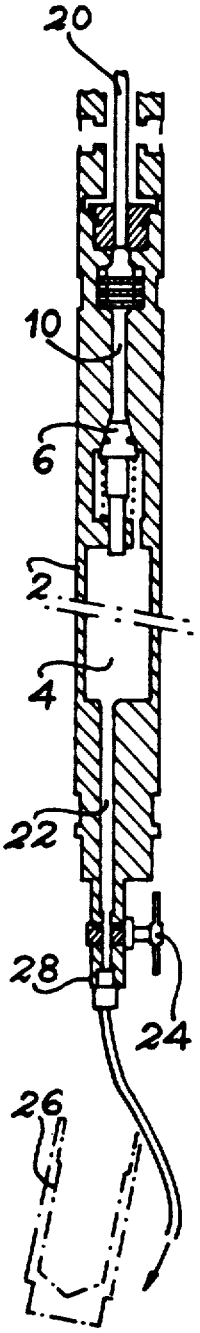
FIG. 2A
FIG. 2B
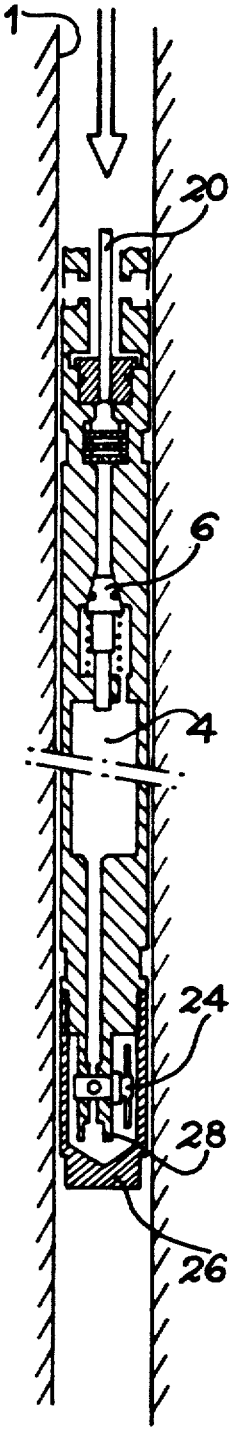
FIG. 2C
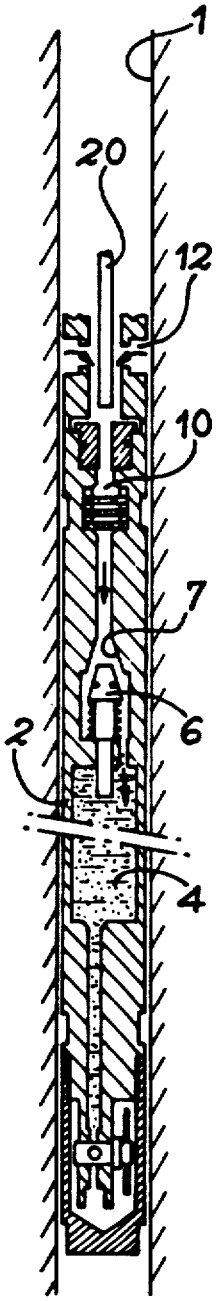
FIG. 2D
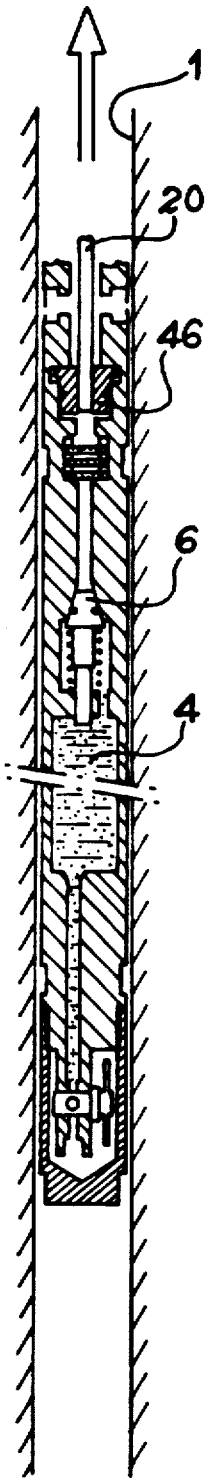

FLUID SAMPLING BOTTLE USABLE IN DEEP BORE HOLES

FIELD OF THE INVENTION

The invention relates to deep bore or drill holes for which it is necessary to sample the liquid-gas mixture. This type of operation is required for monitoring subsoils or substrata containing liquids, for hydrothermalism, for the petroleum industry, for nuclear power stations and for drilling in substrata where there are gas pockets.

PRIOR ART

Numerous water sampling bottles already exist in oceanography and drilling. They make it possible to take water samples and also collect gases dissolved in the water. Certain of these bottles are constituted by a cylinder open at both ends and which is lowered to the requisite depth and remotely closed or sealed. The bottles are placed on a hydrographic cable. The closure of the bottle is brought about by triggering a mechanism by means of a so-called messenger, which is a type of metal flyweight or counterweight which is allowed to slide by gravity along the cable and which triggers the closure of the valve by its impact on the mechanism.

Other bottles use an electrovalve for carrying out the opening and closing of the sampling volume. The electrovalves used have a small passage diameter. Moreover, in order to protect the seat of the electrovalve, it is necessary to carry out a very small diameter filtration on a limited surface. The latter bottle type has large overall dimensions and is not entirely effective when it is a question of recovering both pure water and gas.

The object of the invention is to obviate these disadvantages by proposing a small diameter sampling bottle and which is able to take samples at depths of a mixture of water and gas and which can supply on the one hand gas and on the other pure water.

SUMMARY OF THE INVENTION

Therefore the main object of the invention is a fluid sampling bottle usable in deep bore holes having a central body within which is defined a sampling volume, means for the fluid filling of said sampling volume when the bottle is located on the sampling site, means for closing the sampling volume when the bottle is filled with fluid and a tap for emptying the sampling volume.

According to the invention, the fluid filling means and the means for closing the sampling volume are constituted by a non-return valve placed in a filling sleeve located on a filling pipe linked with the exterior by at least one outer end and with the sampling volume by an inner end, the non-return valve being equipped with a spring calibrated to a predetermined pressure difference value for stopping the filling when said pressure difference between the sampling volume and the sampling pipe intake has reached said predetermined value, a longitudinal piston actuated by a motor for freeing the filling pipe before filling and obstructing it after filling and the tap is used for forming a vacuum in the sampling volume prior to the use of the bottle.

The sampling of liquids containing large amounts of solids, e.g. suspended clays, causes numerous problems with respect to the filtration of the sampled liquid. Thus, according to an embodiment of the invention the filling sleeve has a series of detachable filters placed on the filling pipe and having a decreasing diameter so as to carry out a multistage filtration.

As sampling operations at depth are carried out at hydrostatic pressure, considerable pressures can exist within the bottle. In order that, during the actual sampling operation, the mechanical members such as the motor are not subject to considerable pressure differences, the bottle according to the invention has a preferred construction. Thus, that part of the filling pipe which is obstructed by the piston is a detachable pressure compensating valve member mounted so as to slide in the sleeve in order to compensate the pressure difference between the sampling volume and the pipe intake.

In order to complete the filtration, the outer ends of the pipe can be equipped with filters. The filters used in the sleeve can be of the "fritted" type.

In the preferred embodiment of the invention, the predetermined pressure difference value of the two sides of the non-return valve is 1 bar, i.e. $10^5$ Pa.

The sleeve can e.g. be constituted by the end of a bottle support body within which is located the motor of the piston and within which are located the outer ends and consequently the intake of the sampling pipe; a sleeve body screwed into the end of the support body and incorporating the central part of the sampling pipe at whose end the non-return valve bears on a valve seat and within which is mounted the detachable valve member and the stepped filters; and a valve support screwed onto the sleeve body about the valve seat, in which is slidingly mounted the non-return valve and on which bears the valve spring.

In the preferred embodiment of the bottle according to the invention, the sampling volume is constituted by a bottle body screwed onto the sleeve. The tap is located on an emptying pipe linked with the sampling volume opposite to the filling pipe and surmounted by a protective cap placed upstream of the assembly.

LIST OF DRAWINGS

The invention is described in greater detail hereinafter relative to non-limitative embodiments and the attached drawings, wherein show:

FIG. 1—A sectional view of the sampling bottle according to the invention.

FIGS. 2A, 2B, 2C and 2D—Four partial sections of the bottle according to the according to the invention during four important phases of the use thereof.

FIG. 3—A larger-scale partial section of the sleeve of the bottle according to the invention.

FIG. 4—A larger-scale view of the detachable valve body used in the bottle according to the invention.

DETAILED DESCRIPTION OF AN EMBODIMENT OF THE INVENTION

Figure 1:
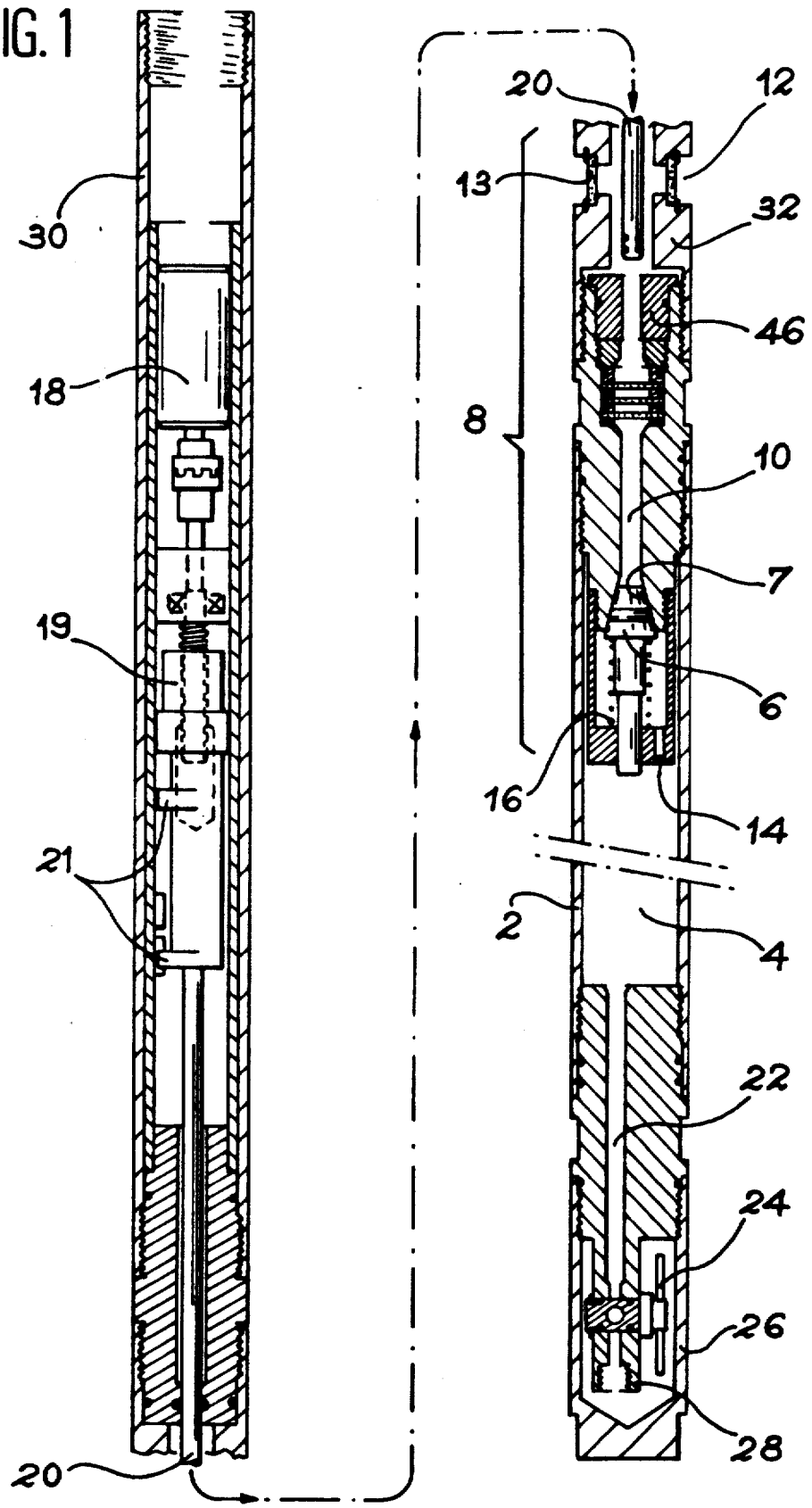

The sampling bottle according to the invention is shown in FIG. 1 and is shown in two parts so as to get it onto one page. In the left-hand part, it is possible to see a tube forming the motor part and which constitutes the support body 30 of the bottle according to the invention. The end 32 of the support body 30 is located at the top of the right-hand part and constitutes the start of the sampling bottle. The latter comprises a central body 2 within which is located the sampling volume 4, into which is to be introduced a given sampled fluid quantity. Like all sampling bottles, that according to the invention has means for filling the filling volume 4, which must be operational when the bottle is located on the sampling site, namely at the bottom of a deep bore hole. The bottle is also equipped with means for closing the sampling volume 4, when the latter is completely filled with the fluid to be sampled.

According to the invention, these fluid filling means and these sampling volume closure means are jointly realized by a plurality of elements mainly constituted by a non-return valve 6 and a longitudinal piston 20, both acting on a filling pipe 10.

The bottle is filled by means of the filling pipe 10, mainly located in a filling sleeve 8 occupying the top of the right-hand part of FIG. 1. The pipe 10 is linked with the outside by at least one outer end 12, namely two lateral orifices. The said filling pipe 10 issues into the filling volume 4 by a second end 14 alongside the non-return valve 6.

An emptying pipe 22 also temporarily links the sampling volume 4 with the exterior in order to empty the same once the bottle has been raised to ground level. This emptying pipe 22 is completed by a tap 24, which is also surmounted by a cap 26 placed in front of the assembly.

The tap 24 also constitutes an important component of the sampling bottle according to the invention. Thus, its use is indispensable for making operational the main elements constituted by the non-return valve 6 and the piston 20. Thus, the operation of the bottle according to the invention requires the formation of a partial vacuum within the sampling volume 4 prior to the lowering of the bottle at the sampling site. Once this operation has been carried out, the bottle is lowered into the bore hole and the withdrawal of the piston 20 is controlled by means of a motor 18 set back with respect to the sleeve 8 and preferably within the support body 30. A screw-nut system 19 mounted at the outlet of the motor 30 permits the displacement of the piston 20, whose travel can be limited by abutments 21. At least one joint 23 is provided for ensuring the necessary seal between the filling pipe 10 and the motor 18. The sampling bottle sleeve 8 is shown in FIGS. 3 and 4.

Figure 3:
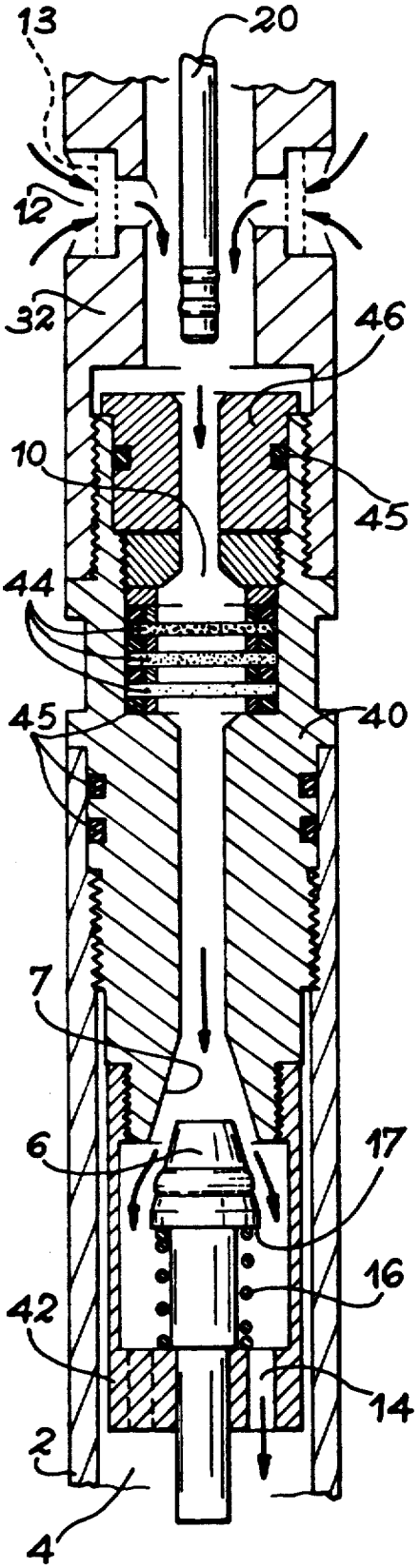
Figure 4:
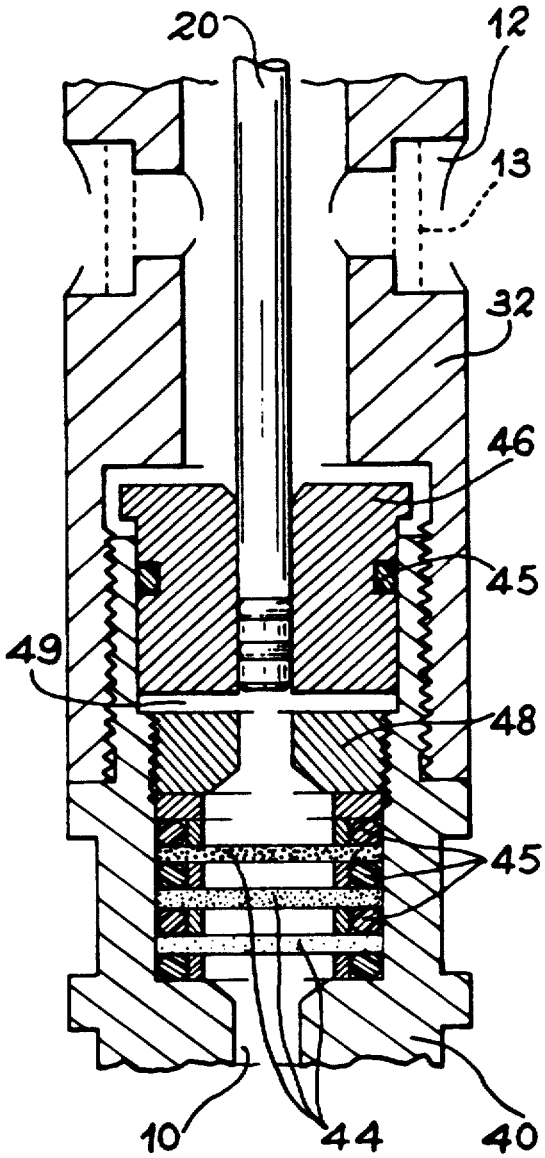

In FIG. 3, upper arrows represent the penetration of the fluid into the pipe 10 by the outer ends 12. The latter are optionally completed by a filter 13, represented by broken lines through its ends 12. The piston 20 is shown in the retracted position, in such a way that the fluid can continue its path through the pipe 10 into the sleeve 8. The bearing structure of the latter is constituted by the end 32 of the support body 30, into which is screwed a sleeve body 40 extended by a valve support 42.

On the filling pipe 10, within the sleeve body 40, are placed several detachable filters 44 separated by O-rings 45. It is therefore possible to constitute an a la carte filtration means by choosing filters 44 adapted to the fluid to be sampled and to the quality of the liquid and the gas to be used following the sampling thereof. In the case of FIG. 3, the first filter is represented by a few large dots in order to symbolize a large diameter filtration for stopping large solid matter. The following filters respectively have decreasing filtration diameters. The last filter can have a very small filtering diameter, so that it only samples very pure liquid. This type of filtration makes it possible to prevent blockages when the sampled fluid contains too much mud.

In the embodiment shown in FIG. 3, a detachable valve body 46 is slidingly mounted in the sleeve body 40 upstream of the filters 44. It is sealed by an O-ring 45. The function of the valve body 46 is to maintain the hydrostatic pressure within the sampling volume 10, particularly when the piston 20 seals the filling pipe 10. Thus, in order to ensure the total sealing of the sampling bottle during its raising, it is preferable to again obstruct the pipe 10 with the aid of the piston 20, although the latter is already obstructed by the non-return valve 16. This introduction of the piston 20 into the sampling pipe 10 leads to an increase in the pressure in the latter and in the sampling volume 4. However, this blocking of the sampling pipe 10 takes place in the detachable valve member 46, so that said downstream pressure rise causes the relative retraction of the detachable valve member 46 in the upstream direction under the constraint of the downstream pressure rise. Therefore the sampling pressure is maintained within the sampling volume 4. This displacement of the detachable valve member is approximately 1 mm.

It is illustrated by the enlargement shown in FIG. 4. Thus, the valve member 46 is shown disengaged from the spacer 48 placed between the latter and the filtration assembly. When the piston 20 penetrates the central part of the pipe 10 and therefore the detachable valve member 46, it has a tendency to reduce the volume trapped between itself and the non-return valve 6. Due to the fact that the detachable valve member 46 is fitted in sliding manner, this volume is maintained by the appearance of a supplementary, large diameter volume 49 between the valve member 46 and the spacer 48.

Due to the fact that the piston 20 supports a pressure not exceeding the pressure of the sampled fluid, it is possible to protect against high pressures the mechanical elements carrying the piston 20 and in this case the motor 18.

The non-return valve 6 is shown in the retracted position in FIG. 3, the liquid entering the sampling volume 10 by an inner end 14 of the sampling pipe 10. The latter is constituted by several holes made in the valve support 42. The spring 16 bears against the valve support 42 and a shoulder 17 of the non-return valve 6.

The complete sleeve 8 is fixed to the central body 2, e.g. by means of a thread and O-rings 45 can complete the arrangement for ensuring the sealing of the assembly.

FIG. 2A diagrammatically shows the sampling bottle according to the invention at the start of its use cycle. The sampling volume 10 is closed, i.e. the non-return valve 6 and the piston 20 both obstruct the filling pipe 10. On the other side, the emptying pipe 22 is closed by the tap 24.

The cap 26 is removed and the end 28 of the emptying pipe 22 is connected to a not shown vacuum source and is symbolized by a small arrow. The tap 24 is then opened and the partial vacuum is formed in the sampling volume 4. Once this operation has been completed, the tap 24 is again closed in order to maintain the vacuum sampling volume. The cap 26 is put back into position and the bottle is ready for despatch to the sampling site, namely to the bottom of a deep bore hole.

As shown in FIG. 2B the bottle is lowered into the bore hole 1. The sampling volume 4 is kept under vacuum during the lowering operation. Once it has arrived on site, in the manner illustrated by FIG. 2C, the piston 20 is raised again, thus freeing the filling pipe 10. Therefore the ambient fluid penetrates by the outer ends 12 into the filling pipe 10, due to the high hydrostatic pressure prevailing externally of the bottle. The non-return valve 6 is disengaged from its seat 7, so that the fluid has access to the sampling volume 4.

On referring to FIG. 2D, when the pressure difference in the sampling volume 4 and in the pipe 10 level with the filters 44 drops below the predetermined value corresponding to the return tension or force supplied by the spring 16 to the non-return valve 6, the latter closes and again obstructs the filling pipe 10. The filling volume 4 is then closed and the bottle can be raised again.

It is then preferable to close the pipe 10 by means of the piston 20. As described hereinbefore, this produces a theoretical pressure increase in the sampling pipe 10 compensated by the slight displacement of the detachable valve member 46.

The predetermined pressure difference value on either side of the non-return valve 5 is approximately 1 bar, i.e. $10^5$ Pa.

All the parts constituting the body of the bottle are preferably made from stainless steel. The sleeve body can assume several sizes between 250 cm and 1 m, as a function of the liquid quantity to be sampled.

The motor can be a GEHRARDT-OWEN motor supplied with 50 volts and operating, by means of the screw-nut system 19, the central piston 20 with a diameter of 6.35 mm. The sleeve 8 is approximately 150 mm long. Such a structure makes it possible to obtain a sampling bottle with a total diameter of 41 mm.

The structure of the bottle and in particular the sleeve 8 formed from several parts permits an easy fitting and dismantling of the different parts of the bottle. This facilitates the cleaning of all the parts and in particular the decontamination of these parts by passing them into acid, in the case where the bottle is used for sampling contaminated fluid. The sampled fluid can either be water, gas and in particular a mixture of water and gas.

The interchangeability of the filters within the sleeve makes it possible to select the purity with which the liquid has to be sampled.

APPLICATIONS OF THE INVENTION

Numerous fields of application can benefit from the use of the sampling bottle according to the invention. Reference is e.g. made to tracking the migration of radioactive elements, geochemical sampling within a main water table for geochemical prospecting or for tracing migrations of chemical or gaseous injections, e.g. underground gas reservoirs, sampling water and gas in hydrothermal fields and sampling operations carried out at nuclear power stations or in waste storage pools.

What is claimed:

1. A fluid sampling bottle usable in deep bore holes having a central body (2) within which is defined a sampling volume (4), means for the fluid filling of said sampling volume (4) when the bottle is located on a sampling site (1), means for closing the sampling volume (4) when the bottle is filled with fluid and a tap (24) for emptying the sampling volume (4), characterized in that the fluid filling means and the means for closing the sampling volume are constituted by a non-return valve (6) placed in a filling sleeve (8) located on a filling pipe (10) linked with the exterior by at least one outer end (12) and with the sampling volume (4) by an inner end (14), the non-return valve (6) being equipped with a spring (16) calibrated to a predetermined pressure difference value for stopping the filling when said pressure difference between the sampling volume (4) and the sampling pipe (10) intake has reached said predetermined value, a longitudinal piston (20) actuated by a motor (18) for freeing the filling pipe (10) before filling and obstructing it after filling and the tap (24) is used for forming a vacuum in the sampling volume (4) prior to the use of the bottle.

2. A bottle according to claim 1, characterized in that the filling sleeve (8) comprises a series of detachable filters (44) on the filling pipe (10) and having a decreasing diameter in order to obtain a multistage filtration.

3. A bottle according to claims 1 or 2, characterized in that part of the filling pipe (10) obstructed by the piston (20) is a pressure compensating detachable valve member (46) mounted so as to slide in the sleeve (8) in order to compensate the pressure difference between the filling volume (4) and the pipe intake level with the outer ends (12).

4. A bottle according to claim 1, characterized in that the outer ends (12) of the filling pipe (10) are equipped with intake filters (13).

5. A bottle according to claim 2, characterized in that the filters (44) placed within the sleeve (8) are of a "fritted" type.

6. A bottle according to claim 1, characterized in that the predetermined pressure difference value is approximately 1 bar, i.e. $10^5$ Pa.

7. A bottle according to claim 1, characterized in that the sleeve is constituted by a hollow length at an end (32) of a support body (30) within which is located the motor (18) of the piston and in which is located at least one orifice (12) of the filling pipe (10); the sleeve body (40) screwed into the end (32) of the support body (30) and incorporating the central part of the filling pipe (10) at an end of which the non-return valve (6) bears on a valve seat (7) and within which are fitted the detachable valve member (46) and the stepped filters (44); and a valve support (42) screwed onto the sleeve body (40) around the valve seat (7), in which is slidingly mounted the valve (6) and on which bears the spring (16).

8. A bottle according to claim 1, characterized in that the sampling volume (4) is constituted by the central body (2) of the bottle screwed onto the sleeve body (40).

9. A bottle according to claim 1, characterized in that the tap (24) is located on an emptying pipe (22) linked with the filling volume (4) opposite to the filling pipe (10) and surmounted by a protective cap (26) positioned upstream of the bottle.

* * * * *